US008635748B2

(12) United States Patent
Anzini

(10) Patent No.: US 8,635,748 B2
(45) Date of Patent: Jan. 28, 2014

(54) MANUALLY ACTIVATED SLIDER CLIP

(75) Inventor: David J. Anzini, Middletown, NY (US)

(73) Assignee: Illinois Tool Works Inc., Glenview, IL (US)

( * ) Notice: Subject to any disclaimer, the term of this patent is extended or adjusted under 35 U.S.C. 154(b) by 291 days.

(21) Appl. No.: 12/488,058

(22) Filed: Jun. 19, 2009

(65) Prior Publication Data

US 2010/0011545 A1 Jan. 21, 2010

Related U.S. Application Data

(60) Provisional application No. 61/080,826, filed on Jul. 15, 2008.

(51) Int. Cl.
*A44B 19/26* (2006.01)

(52) U.S. Cl.
USPC ..... 24/400; 24/399; 383/64

(58) Field of Classification Search
USPC ..... 24/427, 428, 379, 400, 585.1, 585.12, 24/30.5 L, 30.5 R, DIG. 35, 399; 383/64, 63
See application file for complete search history.

(56) References Cited

U.S. PATENT DOCUMENTS 5,283,932 A * 2/1994 Richardson et al. ..... 24/400
5,664,299 A * 9/1997 Porchia et al. ..... 24/400
5,713,669 A * 2/1998 Thomas et al. ..... 383/204
5,809,621 A 9/1998 McCree et al.
5,950,285 A * 9/1999 Porchia et al. ..... 24/400
5,953,796 A 9/1999 McMahon et al.
5,956,924 A * 9/1999 Thieman ..... 53/412
6,014,795 A 1/2000 McMahon et al.
6,047,450 A 4/2000 Machacek et al.
6,182,337 B1 2/2001 Machacek et al.
6,612,002 B1 * 9/2003 Savicki ..... 24/585.1
6,651,297 B1 * 11/2003 Borchardt ..... 24/399
6,789,947 B1 * 9/2004 Kasai ..... 383/64
6,899,461 B2 * 5/2005 Kasai ..... 383/64
6,907,713 B2 * 6/2005 Thieman ..... 53/412
6,954,970 B2 10/2005 McMahon et al.
7,044,639 B2 * 5/2006 Chang ..... 383/64
7,052,181 B2 * 5/2006 Smith et al. ..... 383/64
7,213,303 B1 * 5/2007 Savicki ..... 24/30.5 R
7,506,416 B2 * 3/2009 Hoffman et al. ..... 24/417
7,540,662 B2 * 6/2009 Thieman ..... 383/64
7,552,573 B2 * 6/2009 Thieman ..... 53/412
7,886,412 B2 * 2/2011 Dais et al. ..... 24/585.12
2006/0265842 A1 * 11/2006 Hoffman et al. ..... 24/399

* cited by examiner

*Primary Examiner* — Robert J Sandy
*Assistant Examiner* — Rowland D Do
(74) *Attorney, Agent, or Firm* — McCarter & English, LLP

(57) ABSTRACT

A slider is provided which can be mounted on a zipper without any pre-activation, particularly zippers which are opened by squeezing together a portion of the profiles wherein a fulcrum effect is achieved to separate the profiles. The slider omits at least part of the zipper opening elements so that the user must squeeze the slider together in order to urge the zipper profiles apart thereby opening the zipper.

16 Claims, 5 Drawing Sheets

MANUALLY ACTIVATED SLIDER CLIP

This application claims priority under 35 U.S.C. §119(e) of U.S. provisional application Ser. No. 61/080,826 filed on Jul. 15, 2008, the contents of which are hereby incorporated by reference.

BACKGROUND OF THE INVENTION

1. Field of the Invention

The present invention pertains to a slider clip used with a slider zipper in a reclosable package or bag, whereby the user applies manual force to the clip in order to activate and open the zipper as the clip is slid from the closed position to the open position.

2. Description of the Prior Art

In the prior art of reclosable packages, it is known to use zippers with profiles with interlocking arms wherein the profiles are pressed together to open the zipper (i.e., to separate the profiles), such as is disclosed in U.S. Pat. No. 6,047,450 issued on Apr. 11, 2000 and U.S. Pat. No. 6,182,337 issued on Feb. 6, 2001, both entitled "Slider Zipper Assembly" and issued to Machacek and Kobetsky. Similar prior art includes U.S. Pat. No. 5,953,796 issued on Sep. 21, 1999 and U.S. Pat. No. 6,014,795 issued on Jan. 18, 2000, both entitled "Slider Zipper Assembly" and listing McMahon et al. as inventors.

In the prior art, slider zippers typically operate in that a clip or slider is placed on zipper profiles and the clip or slider is slid by the user to either open (i.e., separate the profiles) or close (i.e., join the profiles) the zipper. The zipper profiles are activated at the time that the clip is inserted onto the profile. That is to say that the zipper profiles are partially opened by a small rib at the point of clip attachment. Virtually all of the zipper designs other than those similar to the above-cited references to Machacek and Kobetsky, a finger typically protrudes from the clip or slider and rests between the profiles in order to maintain a starting position for the zipper opening. In the zipper designs of the above-cited references, the zipper is partially opened and the geometry of the opening side of the clip or slider maintains the partial opening, or pre-activation, necessary to the slider to function correctly.

With at least some small amount of pre-activation required for virtually all slider zipper, it is difficult, if not impossible, to reliable produce a slider zipper for containment purposes. A "parking garage" feature for slider packages has been proposed to allow the pre-activated section of the zipper to be situated over a sealed section of the package. This is unwieldy at best, and has not proven to be reliable.

OBJECTS AND SUMMARY OF THE INVENTION

It is therefore an object of the present invention to provide a clip or slider design which can be used with zipper designs wherein the profiles are separated by pressing the profiles together, such as those disclosed in the above-cited references, to substantially reduce or eliminate the requirement of pre-activation of the zipper.

This and other objects are attained by taking a typical slider such as is used for zipper designs wherein the profiles are separated by the slider sides pressing the profiles together, and removing the opening functionality of the slider while allowing the closing functionality to remain in place. Therefore, the user is required to press the slider sides together thereby pressing together the profiles, typically with the user's fingers, in order to open the zipper. Additionally, a stiffening cross member is typically removed from the opening end in order to make the slider more flexible, allowing for ease of insertion onto the zipper.

By adjusting the amount of finger pressure required to activate the zipper, a child-resistant package can be obtained. Further, without pre-activation, it is possible to obtain a vacuum slider package, with subsequent operation of the slider.

DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
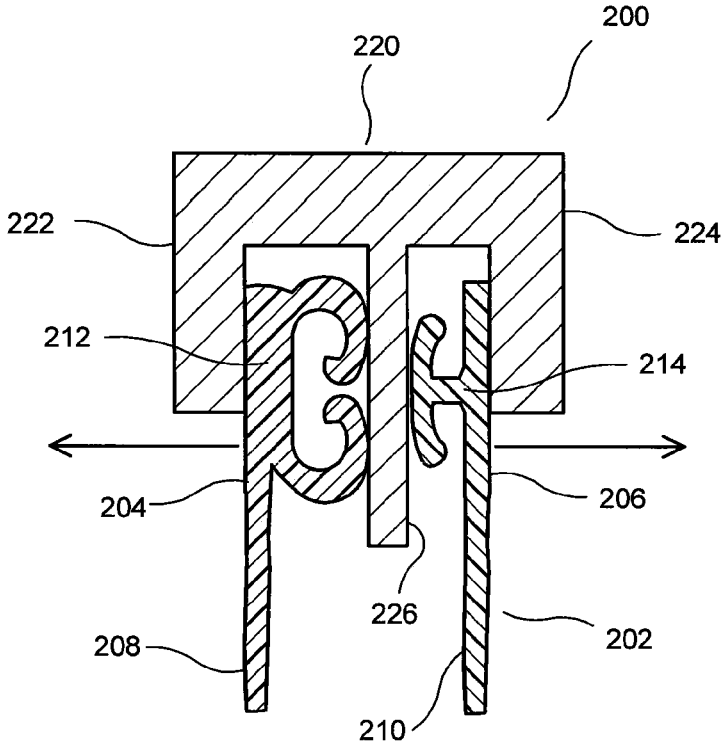
F I G. 1 PRIOR ART
FIG. 1 is illustrative of a typical prior art zipper in which the slider forces act to pull the profiles apart.

Referring now to the drawings in detail wherein like numerals indicate like elements throughout the several views, one sees that FIG. 1 is a diagram of a prior art slider 200 which is mounted on a zipper 202 which includes first profile 204 and second profile 206. First and second profiles 204, 206 include respective first and second flanges 208, 210 which extend from respective first and second interlocking elements 212, 214. First interlocking element 212 is configured as a female element while second interlocking element 214 is configured as a male element. Slider 200 includes a top wall 220 and first and second sidewalls 222, 224. Plough 226 extends from the undersurface of top wall 220 so as to extend between first and second interlocking elements 212, 214 and exert an outwardly extending force, as indicated by the arrows, to separate and force apart the first and second profiles 204, 206.

Figure 3:
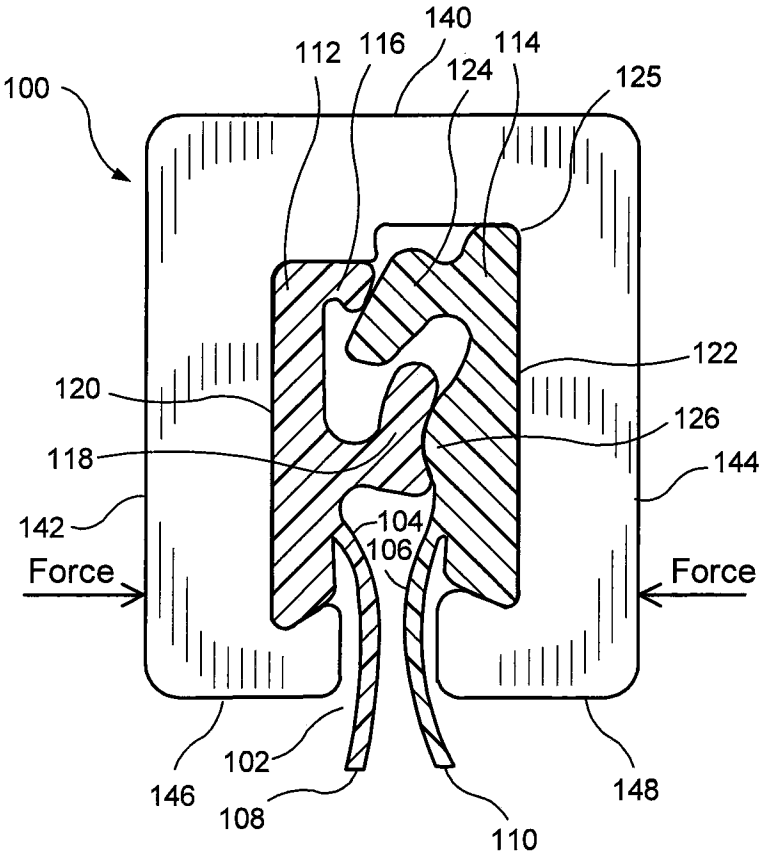
FIG. 3 PRIOR ART
FIG. 3 is illustrative of an opening end of a typical prior art slider of FIG. 2.
Figure 2:
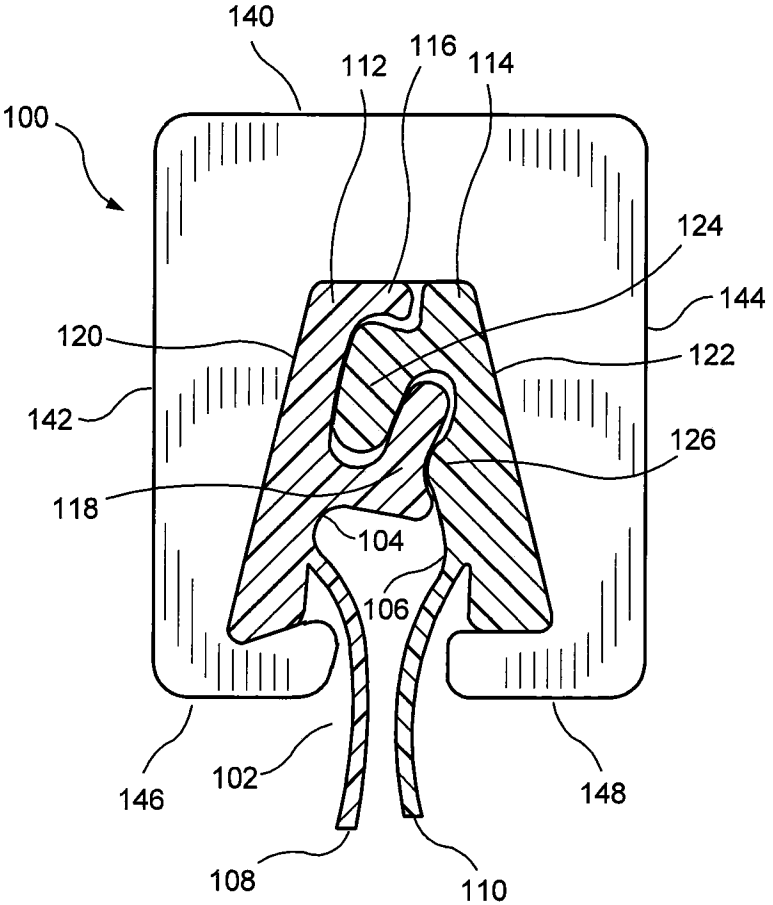
FIG. 2 PRIOR ART
FIG. 2 is illustrative of a closing end of a typical prior art zipper in which the slider joins the profiles.

By contrast, the slider 100 illustrated in FIGS. 2 and 3 (which illustrate the closing end and opening end, respectively, with similar alignment of elements on both figures, rather than a mirror-type image) is mounted on zipper 102. Zipper 102 includes first profile 104 and second profile 106. First and second profiles 104, 106 include respective first and second flanges 108, 110 and respective first and second interlocking elements 112, 114. First interlocking element 112 includes first and second arms 116, 118 thereby forming a female configuration. Second interlocking element 114 includes third arm 124 and fulcrum 126 thereby forming a male configuration which is received and interlocked with the female configuration of first interlocking element 112.

Slider 100 includes top wall 140 and first and second sidewalls 142, 144 which terminate in respective first and second inwardly oriented lips 146, 148. The closing end of FIG. 2 includes interior sidewalls 120, 122 which are inclined while the opening end of FIG. 3 includes interior sidewalls 120, 122 which are substantially parallel to each other. In order to open the zipper 102, the first and second profiles 104, 106 are separated by the lower part of the interior sidewalls 120, 122 pushing the lower portion of the first and second profiles 104, 106 together (as indicated by the arrows in FIG. 3), thereby causing the first profile 104 to pivot about fulcrum 126, thereby causing third arm 124 to pull away from first and second arms 116, 118 so that second profile 106 moves upwardly into recess 125.

Figure 4:
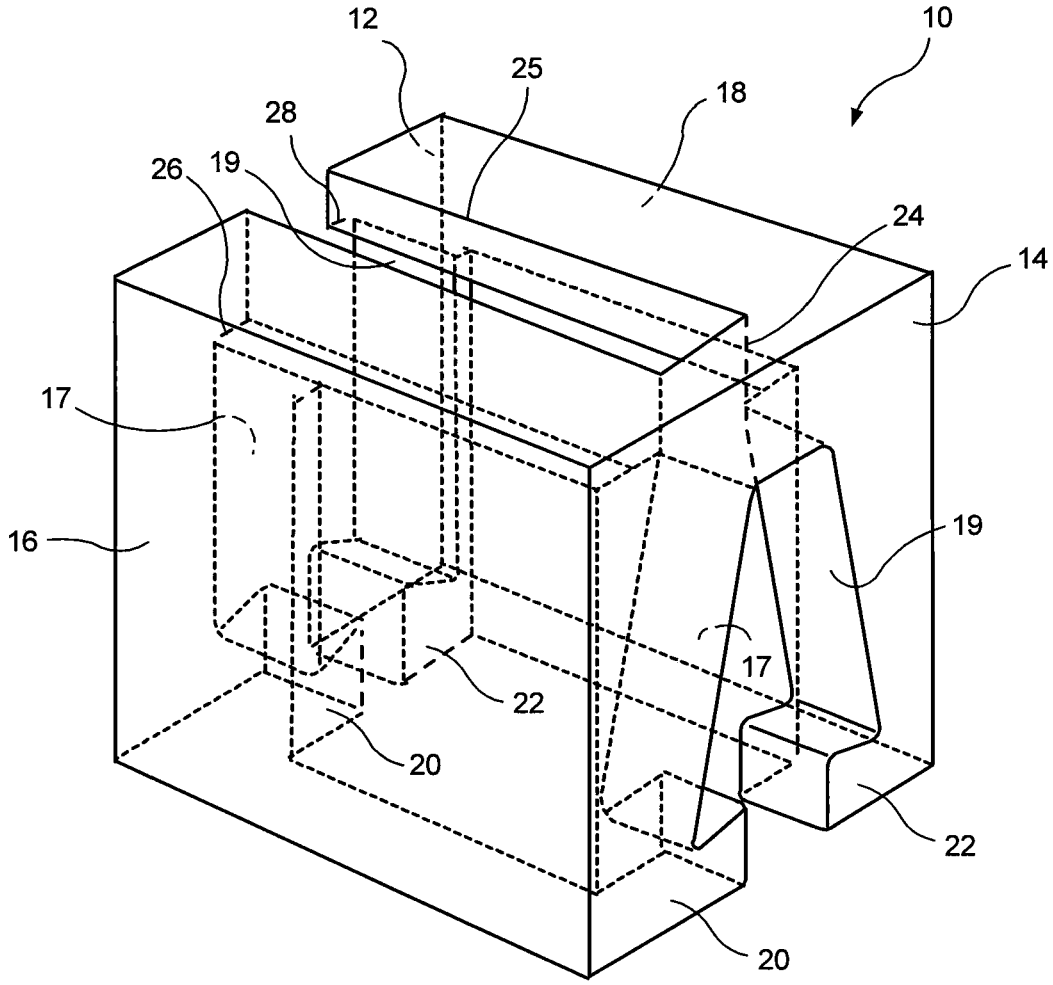
FIG. 4 is a perspective view of an embodiment of the slider of the present invention, particularly illustrating how the opening function of the slider has been removed.
Figure 6:
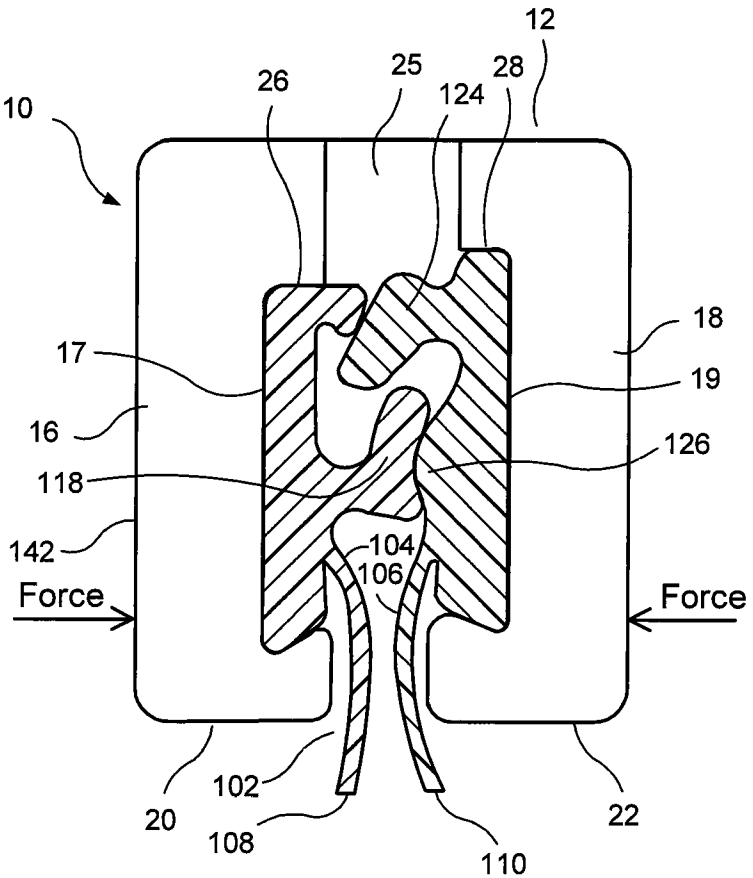
FIG. 6 is a plan view of the opening end of an embodiment of the slider of the present invention.
Figure 5:
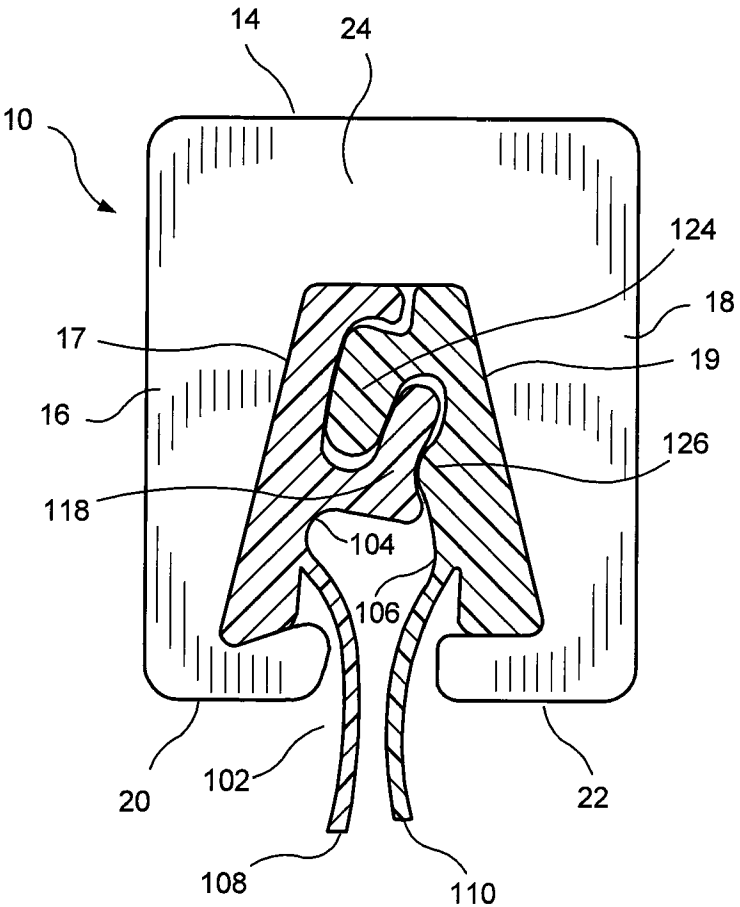
FIG. 5 is a plan view of the closing end of an embodiment of the slider of the present invention.
Figure 7:
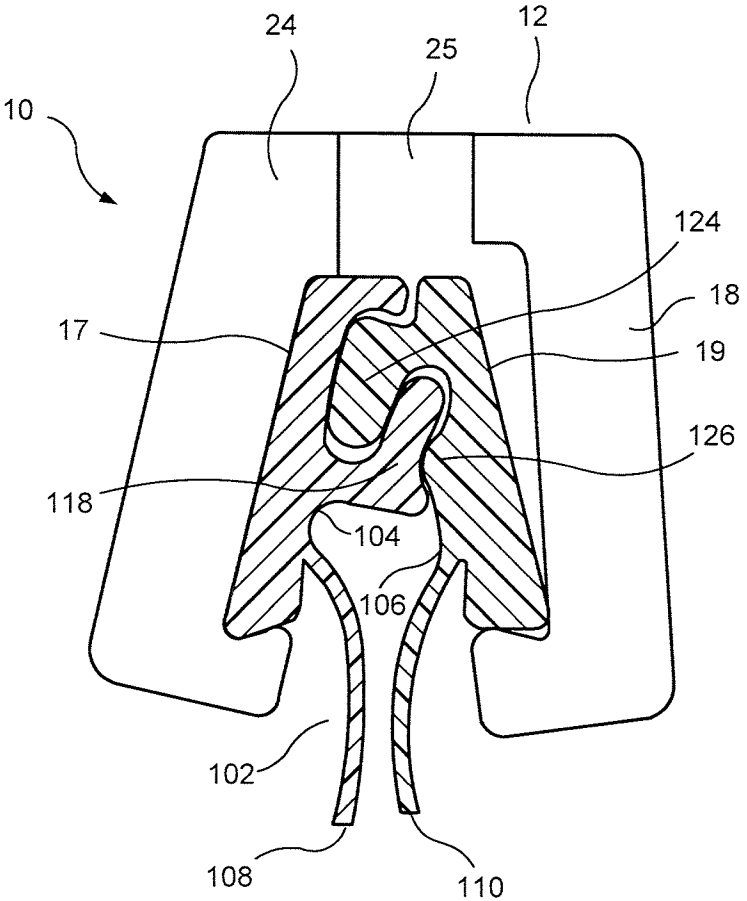
FIG. 7 is a plan view of the opening end of an embodiment of the slider, in the absence of manual force.

An embodiment of the present invention is illustrated in FIGS. 4-6. In particular, the slider 10 is illustrated in FIG. 4. Slider 10 is typically formed of thermoplastic material with sufficient flexibility for the functions described below, but those skilled in the art will recognize a range of equivalents after review of this disclosure. Slider 10 is mounted on a zipper 102 as shown in FIGS. 5 and 6. The zipper 102 of FIGS. 5 and 6 is intended to be at least substantially similar, if not the same, as the zipper 102 illustrated in FIGS. 2 and 3. Slider 10 includes opening end 12 and closing end 14. First and second sidewalls 16, 18 are provided with a space therebetween for receiving the zipper 102, first and second sidewalls 16, 18 terminating in respective first and second inwardly extending lips 20, 22 for maintaining zipper 102 within the space between first and second sidewalls 14, 16. Similar to the configuration illustrated in FIGS. 2 and 3, the interior sidewalls 17, 19 are substantially parallel at the opening end 12 illustrated in FIG. 6 and inclined at the closing end 14 illustrated in FIG. 5. As shown in FIG. 4, the first and second sidewalls 16, 18 are connected by a single upper bridge element 24 proximate to the closing end 14. Typically, no bridge connection is provided between the first and second sidewalls 16, 18 at the opening end 12, rather trough-shaped opening 25 is formed between first and second sidewalls 16, 18 at opening end 12, extending into a central portion of slider 10. Further, trough-shaped opening 25 is positioned to form ridges 26, 28 which limit the upward movement of first and second profiles 104, 106, with ridge 28 being positioned somewhat higher than ridge 26 in order to allow second profile 106 to move upwardly during the opening function. With the absence of a bridge connection at the opening end 12, there is also typically an absence of a rib element, thereby typically eliminating any pre-activation of zipper 102.

With the configuration illustrated in FIGS. 4-6, due to the absence of a bridge element at the opening end 12 and the flexibility of the slider 10, the movement of slider 10 cannot, alone, separate first and second profiles 104, 106 in order to open the zipper 102 in that sufficient force cannot be generated to urge the lower portions of first and second profiles 104, 106 together at opening end 12. Therefore, in order to open the zipper 102, the user must manually press the lower portions of first and second sidewalls 16, 18, proximate to opening end 12, toward each other while moving the slider 10 along the zipper 102 in the opening direction. This manual pressing is illustrated by the arrows in FIG. 6. This action would typically be done by squeezing the slider 10 between the thumb and forefinger of the user. Closing the zipper 102 is performed by merely moving slider 10 in the closing direction.

With such a configuration, the slider 10 can be easily mounted onto zipper 102 without any pre-activation or separation of first and second profiles 104, 106. This is useful for many applications, particularly vacuum packing. Moreover, the resulting zipper 102 may be made at least child-resistant by increasing the manual squeezing force which must be applied to open the zipper 102.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A slider for a zipper of the type wherein opening of the zipper is achieved by urging elements of the zipper together, the slider comprising:

a first end and a second end;

a first sidewall extending from the first end to the second end;

a second sidewall, opposing the first sidewall, extending from the first end to the second end, thereby forming a space between the first and second sidewalls configured and arranged for the zipper passing therethrough;

a connector between the first sidewall and the second sidewall;

wherein, in the absence of an additional manual force to push the sidewalls towards each other, the first and second sidewalls provide an insufficient force to separate profiles of the zipper and the additional manual force must be provided to the lower portions of the sidewalls to push the sidewalls towards each other and to pivot one zipper profile about a fulcrum on the other zipper profile thereby separating a portion of the profiles of the zipper;

the second end including elements for interlocking profiles of the zipper in response to motion of the slider along the zipper in a closing direction; and the slider being formed of a material which is sufficiently flexible to allow a user to manually press the lower portions of the slider thereby urging the first and second sidewalls together in order to separate the profiles of the zipper.

2. The slider of claim 1 wherein the connector is positioned proximate to a top of the second end of the slider.

3. The slider of claim 2 wherein the first sidewall is substantially free of connection to the second sidewall proximate to the first end.

4. The slider of claim 3 further including an opening formed between the first and second sidewalls at the first end, the opening positioned so as to form first and second ridges to limit upward travel of the zipper.

5. The slider of claim 3 wherein the first and second sidewalls terminate in respective first and second inwardly extending lips configured and arranged for maintaining a zipper therein.

6. The slider of claim 5 wherein interior surfaces of the first and second sidewalls are inclined at the second end.

7. The slider of claim 5 wherein the interior surfaces of the first and second sidewalls are substantially parallel at the first end.

8. The slider of claim 1 wherein the material is a thermoplastic material.

9. A slider zipper including:

zipper profiles of the type wherein separation of the zipper profiles is achieved by urging elements of the zipper profiles together; and a slider comprising:

a first end and a second end;

a first sidewall extending from the first end to the second end;

a second sidewall, opposing the first sidewall, extending from the first end to the second end, thereby forming a space between the first and second sidewalls through which the zipper profiles pass;

a connector between the first sidewall and the second sidewall;

wherein, in the absence of an additional manual force to push the sidewalls towards each other, the first and second sidewalls provide an insufficient force to separate profiles of a zipper and the additional manual force must be provided to the lower portions of the sidewalls to push the sidewalls towards each other and to pivot one zipper profile about a fulcrum on the other zipper profile thereby separating the zipper profiles;

the second end including elements for interlocking the zipper profiles in response to motion of the slider along the zipper profiles in a closing direction; and the slider being formed of a material which is sufficiently flexible to allow a user to manually press the lower portions of the slider thereby urging the first and second sidewalls together in order to separate the zipper profiles.

10. The slider zipper of claim 9 wherein the connector is positioned proximate to a top of the second end of the slider.

11. The slider zipper of claim 10 wherein the first sidewall is substantially free of connection to the second sidewall proximate to the first end.

12. The slider zipper of claim 11 further including an opening formed between the first and second sidewalls at the first end, the opening positioned so as to form first and second ridges to limit upward travel of the zipper.

13. The slider zipper of claim 11 wherein the first and second sidewalls terminate in respective first and second inwardly extending lips configured and arranged for maintaining the zipper profiles therein.

14. The slider zipper of claim 13 wherein interior surfaces of the first and second sidewalls are inclined at the second end.

15. The slider zipper of claim 13 wherein the interior surfaces of the first and second sidewalls are substantially parallel at the first end.

16. The slider zipper of claim 9 wherein the material is a thermoplastic material.

* * * * *